United States Patent [19]

Kaneko

[11] 4,383,142

[45] May 10, 1983

[54] BEADING FOR A SUITCASE

[76] Inventor: Katsukichi Kaneko, 2-20-9, Daito-ku, Tokyo, Japan

[21] Appl. No.: 327,093

[22] Filed: Dec. 3, 1981

[51] Int. Cl.[3] ..... A45C 13/36

[52] U.S. Cl. ..... 190/49; 190/54

[58] Field of Search ..... 190/49, 50, 54

[56] References Cited

U.S. PATENT DOCUMENTS 3,298,480 1/1967 Kish ..... 190/54

4,116,311 9/1978 Davis ..... 190/54 X

*Primary Examiner*—Donald F. Norton

*Attorney, Agent, or Firm*—Fleit, Jacobson & Cohn

[57] ABSTRACT

A beading for baggage includes an elongate flexible tubular portion with legs or flanges projecting therefrom. A band spring is rotatably positioned in the tubular portion and dimensioned so that the spring is relatively flexible in one direction and relatively inflexible in another direction. The spring urges the tubular portion into a sharply defined shape. The band spring can rotate when the tubular portion is deformed in the inflexible direction of the band spring and can rotate back to restore the tubular portion to its sharply defined shape.

7 Claims, 7 Drawing Figures

BEADING FOR A SUITCASE

BACKGROUND OF THE INVENTION

This invention relates to beadings of a suitcase or the like, and more particularly, to beadings having a structure which is adapted to prevent the bending to winding of the corners of a suitcase towards the inside.

Heretofore, the beading of a suitcase has been constructed by inserting a coil spring or a wire into a round tubular head portion that forms the bead at the edges of the suitcase, or by sealing a soft synthetic resin material into a hard synthetic round tubular head portion. However, such beadings are comparatively flexible and bend or wind in any direction so that the corners bend or wind naturally towards the inside of the suitcase. Accordingly, such a suitcase has such defects as failing to retain a sharply defined external shape and becoming unattractive in appearance. These defects reduce the commercial value of the suitcase.

SUMMARY OF THE INVENTION

In the present invention, a beading of a suitcase or the like includes a band spring with a flattened cross-section, longer on one side than another. The spring, preferably rectangular in section, is positioned in the usual tubular head portion that forms the bead. The spring is relatively flexible in one direction and relatively inflexible in another direction, and urges the tubular head portion into a stiff shape when that portion is bent to join the sides of a suitcase.

BRIEF DESCRIPTION OF THE DRAWINGS

A more complete understanding of the invention and its advantages will be apparent from the following Detailed Description taken in conjunction with the accompanying drawings, in which.

DETAILED DESCRIPTION

Figure 1:
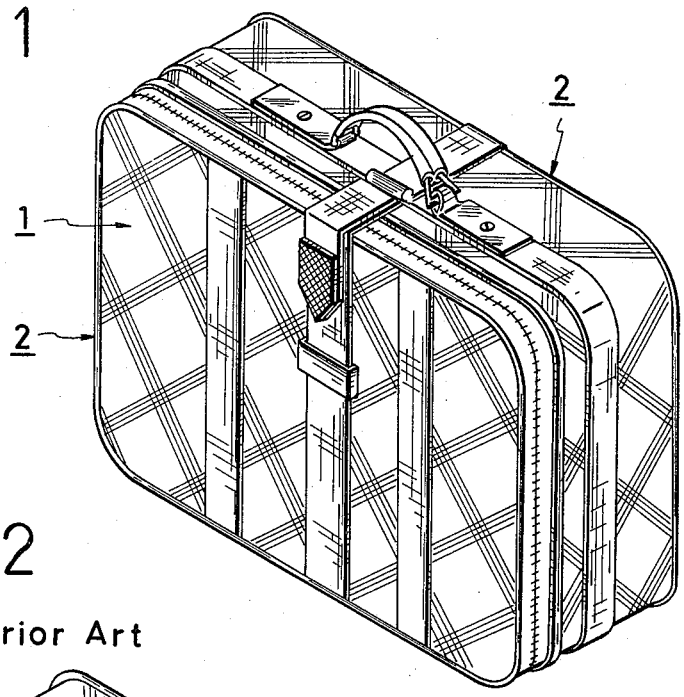
FIG. 1 is a perspective view of a suitcase constructed with beadings.
Figure 2:
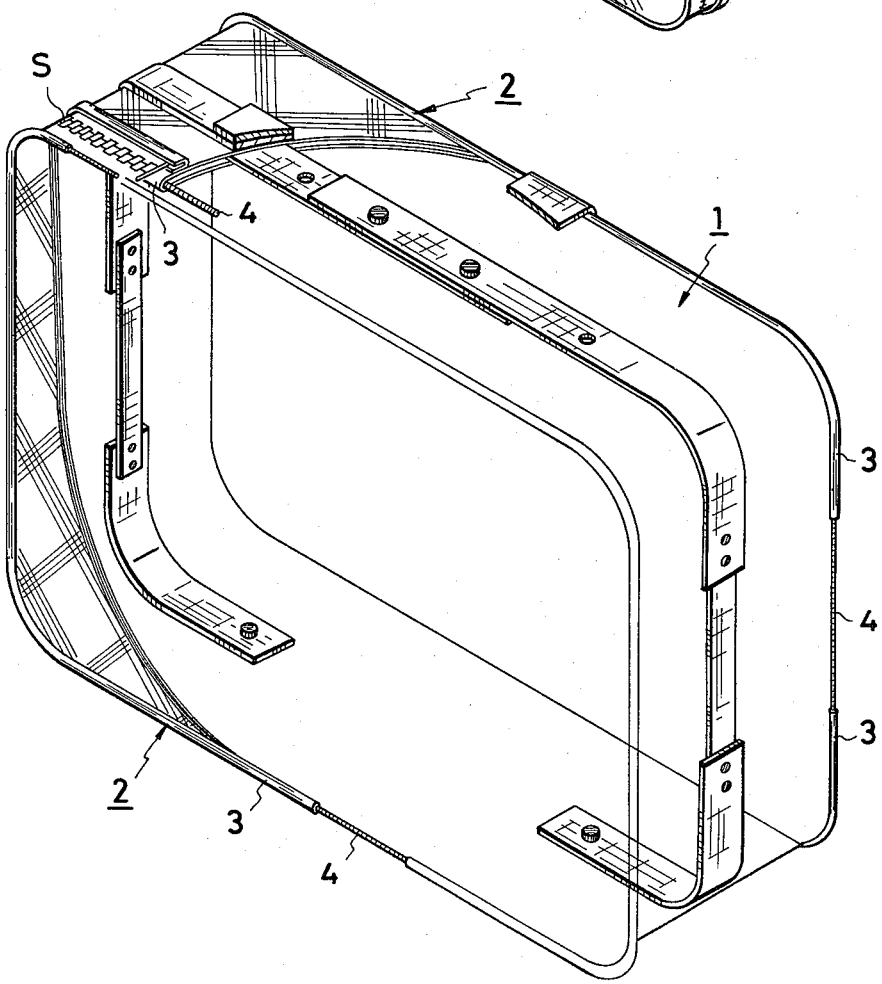
FIG. 2 Prior Art
FIG. 2 is a diagramatic perspective view of a suitcase with parts broken away for clarity and illustrating prior art beadings having coil springs inserted therein.
Figure 3:
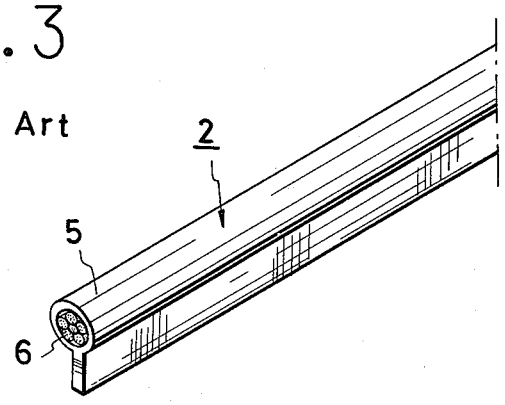
FIG. 3 Prior Art
FIG. 3 is a fragmentary perspective view of a segment of prior art beading having a soft synthetic resin inserted therein.

A suitcase 1 in FIG. 1 is illustrative of the kind of luggage and the like to which this invention applies. Beadings 2 of such suitcases have been constructed by inserting a coil spring 4 or a wire into a round tubular head portion 3 as shown in FIG. 2, or by sealing a soft synthetic resin material 6 into a hard synthetic round head portion 5, as shown in FIG. 3. In use, each of the prior art beadings 2 includes the tubular head extending along the corners of the suitcase outside the suitcase with legs or flanges 8 attached to the material forming the body of the case. Such beadings are comparatively flexible and bend or wind in any direction, so that the corner portions bend or wind naturally towards the inside of the suitcase 1 when the suitcase 1 takes the form illustrated in FIG. 1. The suitcases thus lose their sharply defined shape. In addition to being located about the edges of the larger faces of the suitcase, beading of the kind to which this invention relates can be located at the edge forming the opening, proximate an interior of a slide fastener S.

Figure 4:
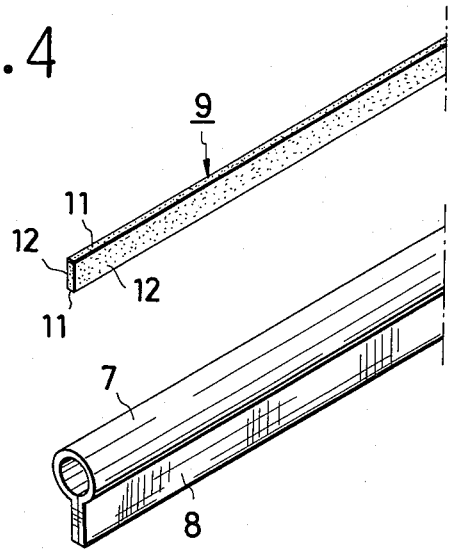
FIG. 4 is a fragmentary perspective view of the component parts of a beading constructed in accordance with the present invention.
Figure 5:
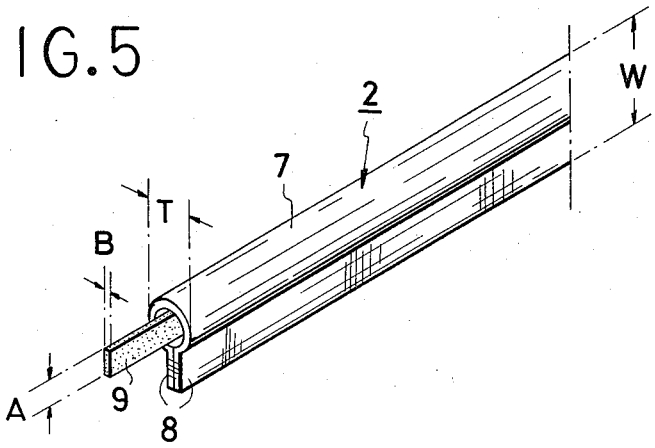
FIG. 5 is a fragmentary perspective view of the assembled beading according to the present invention.
Figure 6:
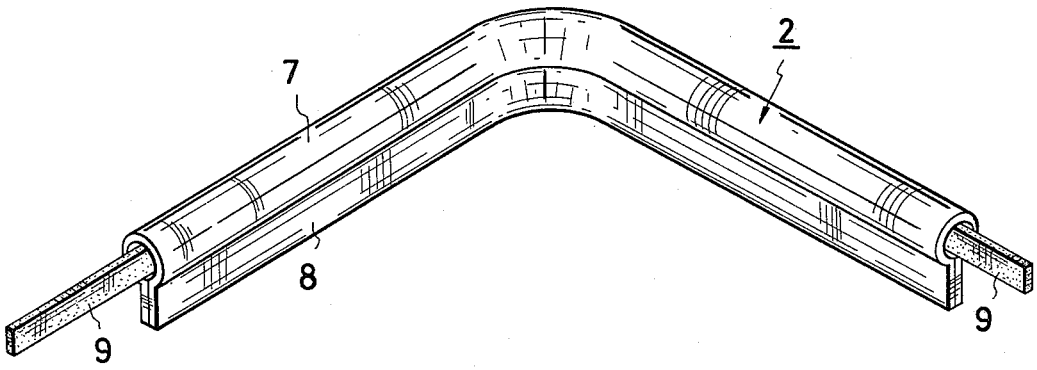
FIG. 6 is a perspective view of a portion of beading bent across its width.

In the exemplary embodiment of the beading 2 according to this invention, in FIGS. 4 and 5, the numeral 7 indicates a round tubular head portion made of synthetic resin with integrally constructed leg pieces 8 extending from the head and forming joined flanges running along the length of the beading. The beadin 2 has two transverse dimensions, its width W and its thickness T. Numeral 9 indicates a steel band spring having a noncircular cross-section shape. Its cross-sectional shape has a first dimension A longer than its second dimension B. In FIGS. 4 to 7 the band is rectangular in cross-section. The rectangular band 9 has narrow edges 11 and wide sides 12. The sides 12 are sufficiently smaller than the inner diameter of the tubular head portion 7 so that when the steel band spring 9 is inserted into head portion 7, the band can rotate inside the head. The positions of the wider sides 12 and narrow edges 11 of the rectangular cross-section can thus be rotated from horizontal to vertical or vice vers.

The steel band spring 9 bends easily when the bending forces are applied normal to the wide side 12, but bends only with extreme difficulty when the bending forces are applied normal to the narrow edges 11. Accordingly, the beading of this invention is characterized by the fact that when the beading is bent in the direction shown in FIG. 6, the wide sides 12 of the steel band spring 9 inside the round head portion 7 turn to be parallel to the legs 8, or in the vertical direction in FIG. 6, to accommodate the bending. When the beading is bent as shown in FIG. 7, the wide sides 12 of the steel band spring 9 turn to be normal to the legs 8, or in the horizontal direction in FIG. 7, to accommodate the bend.

Figure 7:
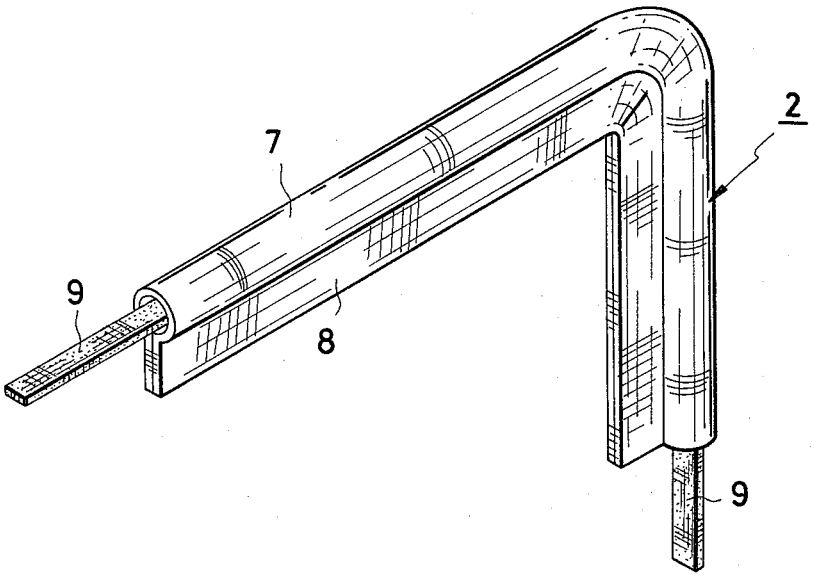
FIG. 7 is a perspective view of a portion of beading bent across its thickness.

Since the beading of the present invention includes a steel band spring having a flattened cross-section which is loosely and rotatively inserted into the round head portion thereof as described above, when the beading is used at the corner portion of a suitcase 1, the band is bent at the corners as shown in FIG. 7. Therefore, the steel band spring is positioned to keep the band easy to bend in a vertical plane, parallel the legs 8 and the large front and back faces of the suitcase. The band is difficult to bend inward along the shorter faces of the suitcase.

Accordingly, because the beading 2 resists bending as described, the corner portion of the suitcase resists bending towards the inside. The beading keeps the corner projecting outwardly, thereby keeping the shape of the suitcase extremely sharp or well-defined. Further, when a strong pressure from the outside deforms a corner, the steel band spring automatically rotates and allows the corner portion temporarily to bend towards the inside. However, when the outside force is removed, the corner returns to its original shape quickly. The action of the steel band spring returns the sharp outer shape of the corner portion.

Finally, the beading according to this invention can be produced in large amounts at lower cost than beadings employing conventional coil springs.

While one embodiment of the present invention has been described in detail herein, various further modifications may be made without departing from the spirit and scope of the invention.

I claim:

1. In a beading of a suitcase or the like comprising a flexible, elongated tubular portion and a projecting leg secured to the tubular portion, the improvement comprising;

a band spring rotatably positioned within said tubular portion, dimensioned so that said spring is relatively flexible in one direction and relatively inflexible in another direction, for urging said tubular portion and thereby the suitcase into a relatively sharply defined shape.

2. The beading of claim 1 wherein said band spring has a rectangular cross-section so that said spring is relatively flexible in the direction perpendicular to the wider sides of said rectangle and is relatively inflexible in the direction perpendicular to the shorter sides of said rectangle.

3. The beading of claim 2 wherein said tubular portion has a circular cross-section, with an inside diameter greater than the width of the band spring across its wider sides.

4. Luggage including the beading of claim 1 wherein said beading is attached to the luggage along substantially the entire edges about the circumference of larger front and rear surfaces of the luggage.

5. Luggage according to claim 4 wherein the band spring of the beading is disposed in the tubular portion with the wider cross-sectional dimension of the band generally normal to the larger front and rear surfaces of the luggage.

6. Luggage including the beading of claim 1 wherein said beading is located proximate and internally of a slide fastener extending at least partly around the luggage.

7. Luggage including the beading of claim 1 wherein said band spring has wide sides and shorter edges, said band spring mounted to rotate upon application of an external force in a direction at least substantially normal to a shorter edge and to return on removal of the force.

* * * * *

UNITED STATES PATENT AND TRADEMARK OFFICE

CERTIFICATE OF CORRECTION

PATENT NO. : 4,383,142

DATED : May 10, 1983

INVENTOR(S) : KATSUKICHI KANEKO

It is certified that error appears in the above-identified patent and that said Letters Patent is hereby corrected as shown below:

On the title page, line [76], the address of the Patentee should read --2-20-9, Ryusen, Daito-ku--.

Signed and Sealed this

*Twenty-second* Day of *October 1985*

[SEAL]

*Attest:*

DONALD J. QUIGG

*Attesting Officer*

*Commissioner of Patents and Trademarks—Designate*